US007902801B2

(12) United States Patent
Mandal

(10) Patent No.: US 7,902,801 B2
(45) Date of Patent: Mar. 8, 2011

(54) LOW DROPOUT REGULATOR WITH STABILITY COMPENSATION CIRCUIT

(75) Inventor: Sajal Kumar Mandal, Howrah (IN)

(73) Assignee: ST-Ericsson SA, Geneva (CH)

( * ) Notice: Subject to any disclaimer, the term of this patent is extended or adjusted under 35 U.S.C. 154(b) by 0 days.

(21) Appl. No.: 12/535,433

(22) Filed: Aug. 4, 2009

(65) Prior Publication Data

US 2009/0289610 A1 Nov. 26, 2009

Related U.S. Application Data

(63) Continuation of application No. 11/609,676, filed on Dec. 12, 2006, now Pat. No. 7,589,507.

(30) Foreign Application Priority Data

Dec. 30, 2005 (IN) ..... 3532/DEL/2005 PRO
Aug. 10, 2006 (IN) ..... 3532/DEL/2005

(51) Int. Cl.
*G05F 1/575* (2006.01)

(52) U.S. Cl. ..... 323/273; 323/270; 323/280

(58) Field of Classification Search ..... 323/273, 323/270, 280, 274–279, 281
See application file for complete search history.

(56) References Cited

U.S. PATENT DOCUMENTS 5,986,910 A * 11/1999 Nakatsuka ..... 363/73
6,188,211 B1 2/2001 Rincon-Mora et al.
6,333,623 B1 12/2001 Heisley et al.
6,340,918 B2 * 1/2002 Taylor ..... 330/292
6,603,292 B1 8/2003 Schouten et al.
6,690,147 B2 * 2/2004 Bonto ..... 323/280
6,700,361 B2 3/2004 Gregorius
7,589,507 B2 * 9/2009 Mandal ..... 323/273
2004/0164789 A1 8/2004 Leung et al.
2005/0127885 A1 * 6/2005 Jung ..... 323/282
2006/0273771 A1 * 12/2006 van Ettinger et al. ..... 323/273

* cited by examiner

*Primary Examiner* — Harry Behm
(74) *Attorney, Agent, or Firm* — William J. Kubida; Peter J. Meza; Hogan Lovells US LLP

(57) ABSTRACT

The present invention provides a low dropout (LDO) regulator with a stability compensation circuit. A "zero frequency" tracking as well as "non-dominant parasitic poles' frequency reshaping" are performed to achieve a good phase margin for the LDO by means of the compensation circuit. In this compensation method neither a large load capacitor nor its equivalent series resistance is needed to stabilize a regulator. LDO regulators, in system on chip application, having load capacitors in the range of few nano-Farads to few hundreds of nano-Farads can be efficiently compensated with this compensation method. A dominant pole for the regulator is realized at an internal node and the second pole at an output node of the regulator is tracked with a variable capacitor generated zero over a range of load current to cancel the effect of each other. A third pole of the system is pushed out above the unity gain frequency of the open loop transfer function with the help of the frequency compensation circuit. The compensation technique is very effective in realizing a low power, low-load-capacitor LDO desirable for system on chip applications.

20 Claims, 10 Drawing Sheets

LOW DROPOUT REGULATOR WITH STABILITY COMPENSATION CIRCUIT

RELATED APPLICATIONS

The present invention claims priority from, and is a continuation application of, U.S. patent application Ser. No. 11/609,676 filed Dec. 12, 2006, which claims priority of India Patent Application No. 3532/Del/2005, first filed Dec. 30, 2005 as a provisional application, for which a complete specification was filed Aug. 10, 2006, said applications being incorporated herein in their entireties by this reference.

FIELD OF THE INVENTION

This invention relates to a field of voltage regulators, and more specifically to a stability compensation of low-load-capacitor, low power, low dropout voltage regulator (LDO) providing a good phase margin over no load to full load current range.

BACKGROUND OF THE INVENTION

The driving force behind the increasing demand of low dropout regulators (LDO) stems from the requirement of efficient power management in battery operated portable consumer products for their low power operations. The fundamental design challenge in an LDO is to stabilize it over a zero load current (no load) to a maximum load current (full load) required for a particular application. In addition to stability, various other performance parameters of the LDO also turn to be critical depending on a particular application, where it is being incorporated. LDO supplying current to low voltage sub-100 nm channel length load circuitry must have a very good transient response, more specifically the transient voltage peak and trough in a controlled output of the LDO should not exceed a certain voltage range both during dynamic load current step and large current spike inherent to digital load circuitry for safe operations of the load circuitry. More over, the stability must be ascertained for both kinds of loading effect offered by the load circuitry. Loading effect of analog circuits is closer to a current sink type load, whereas of digital circuits it is closer to a resistive type load. In reality, the LDO sees at its output the combination of resistive as well as the current sink type load.

FIG. 1 describes a block diagram of a conventional LDO 100 according to a prior art 1. The LDO 100 includes an error amplifier 110, a voltage buffer 120, a PMOS driver transistor 130 and a feedback network comprising with resistors $R_1$ (101) and $R_2$ (102). The load to the LDO 100 is modeled with a resistive load $R_L$ (105) in parallel with a current sink load $I_L$ (106). An off-chip decoupling capacitor $C_L$ (103) is connected to an output of the regulator 100 for dominant pole frequency (equation 1.1A) compensation. A bond inductance $L_B$ (107) associated with the bond wire connecting the internal output (node 108) of the regulator 100 to the external positive terminal (node 109) of the off-chip decoupling capacitor $C_L$ (103) can also be considered in the high frequency response of LDO. A load current from the output (node 108) of the regulator 100 can be drawn internally (from node 108 itself) or it can be routed externally from output pin (node 109), where an external decoupling capacitor is connected and fed back to the chip through other core-supply pins (when provided in the chip). Accordingly, positions of the $I_L$ (106) and $R_L$ (105) change to node 108 in FIG. 1. A small series resistance in series with the bond inductance 107 can also be considered.

The dominant pole frequency for prior art 1 can be approximated by $$P_1 = \frac{-G_O}{C_L} \tag{1.1A}$$

where $G_o$ is the total conductance at the output node 108 of LDO 100 and $$G_O = G_{DS2} + G_{FB} + G_L$$

where, $G_{DS2}$ is the output conductance of the PMOS driver transistor 130, $$G_{FB} = \frac{1}{R_1 + R_2}$$

And $$G_L = \frac{1}{R_L}$$

For a current sink type load $G_L$ can be neglected and for most of the load current range $G_O$ is decided by $G_{DS2}$, which can be approximated by $$G_{DS2} = \lambda \times (I_L + I_{SINK}) \approx \lambda \times I_L \tag{1.1B}$$

where $I_L$ is the load current (106) and $I_{SINK}$ is the bleed current flowing through the feedback resistor ($R_1$+$R_2$), which is generally negligible compared to $I_L$ in low power LDO regulators.

Therefore, for current sink type load the dominant load pole for prior art 1 can be represented by $$P_1 \cong \frac{-\lambda \times I_L}{C_L} \tag{1.1C}$$

For a resistive load equation 1.1C also includes $G_L$ as given below:

$$P_1 \cong \frac{-(\lambda \times I_L + G_L)}{C_L} \tag{1.1D}$$

The non-ideality in the off-chip capacitor $C_L$ (103) is modeled with a series resistance $R_{ESR}$ (104), which is called an Equivalent Series Resistance (ESR). The ESR (104) generates a zero in the loop transfer function at a frequency that can be approximated by $$Z_{ESR} \cong \frac{-1}{R_{ESR} \times C_L} \tag{1.2}$$

The second pole for prior art 1 occurs at the output node 112 of the voltage buffer 120 and can be approximated by $$P_2 = \frac{-G_{O2}}{C_{par}} \tag{1.3}$$

where $G_{O2}$ is an output conductance of the voltage buffer 120 and $C_{par}$ is the total capacitance at node 112, which is mainly contributed from the gate capacitance of the large PMOS driver transistor 130.

Stereotypically, the ESR zero ($Z_{ESR}$ in equation 1.2) is utilized to cancel out the effect of second pole $P_2$ (equation 1.3) and thus a good stability margin is achieved for prior art 1.

A third pole in the loop transfer function of prior art 1 generally occurs at an output node 111 of the error amplifier 110 and can be given by $$P_3 = \frac{-G_{01}}{C_{01}} \tag{1.4A}$$

where $G_{01}$ is the output conductance of the error amplifier 110 and $C_{01}$ is the total node capacitance at node 111, whose main contribution comes from the gate capacitance of the input MOS (metal-oxide) transistor of the voltage buffer 120.

In addition, there is a fourth pole ($P_4$), which is originated from the total bypass capacitance of node 108 (this capacitance comes from the chip capacitance when node 108 internally drives the load circuitry and routing capacitance) except $C_L$ (103) and ESR of external decoupling capacitor $C_L$ (103) which can be approximated by $$P_4 \cong \frac{1}{ESR \times C_B} \tag{1.4B}$$

The above pole $P_3$ (equation 1.4A) and $P_4$ (equation 1.4B) (are called parasitic poles for prior art 1. For designs with high ESR the second pole is given by equation 1.4B and the third pole from equation 1.3, but it does not modify the compensation method and the number of poles in the system remains same.

The philosophy of the compensation method utilized in prior art 1 is to select a load capacitor $C_L$ (103) too large to include these parasitic poles $P_3$ (equation 1.4A) and $P_4$ (equation 1.4B) within the unity gain frequency (equation 1.6) even at the highest load current drawn from the LDO.

Loop gain for prior art 1 for a unity feed back factor is given by $$Gain_{loop} = \frac{G_{mi} \times G_{mp}}{G_{01} \times G_O} \tag{1.5}$$

and a loop gain bandwidth or the unity gain frequency (UGF) for prior art 1 is given by $$f_T = Gain_{loop} \times p_1 = \frac{G_{mi} \times G_{mp}}{G_{01} \times C_L} \tag{1.6}$$

where, $G_{mi}$, $G_{mp}$ are transconductances of the error amplifier (110) and the driver transistor (130).

Large value of $C_L$ (103) reduces the bandwidth (equation 1.6) of prior art 1, which increase a transient response time of the LDO 100. However, the load capacitor $C_L$ (103) can be made large enough to supply or sink the instantaneous transient load current spikes without much affecting the controlled output. The most crucial drawback of prior art 1 arises from the fact that the LDO stability is critically dependent on an ESR value, which largely depends not only on a manufacturer of the capacitor, but also varies with an operating frequency and temperature and thus creates stability problem in actual scenarios.

In addition, the recent trend in a system integration demands system on chip (SoC) solution, which left the designers with either a capacitor free on-chip LDO or an LDO with very small surface mount (SM) type external decoupling capacitor to minimize the transient voltage peaks and troughs in a controlled output voltage of the regulator. Compared to normal leaded resistors and capacitors, the SM counterparts take much smaller area, which can be very easily incorporated into the SoC integration.

Load capacitor of external decoupling capacitor free LDO consists of the total chip capacitance it drives. The chip capacitance includes the equivalent gate capacitance of the load circuitry and the big n-well capacitance (a substrate of a PMOS load transistor and other n-wells connected to a regulated supply), and other parasitic capacitance (routing capacitor etc). Moreover, few on-chip decoupling capacitors may also be connected to the output of the regulator for better transient response of the LDO. Therefore, the load capacitor value provided to the designers for an LDO in SoC application is generally varies from a few nano-Farads to a few hundreds of nano-Farad depending on the application. Henceforth, the LDO having a load capacitor value in the above mentioned range is called as a low-load-capacitor LDO.

Stability is to be achieved for the low-load-capacitor LDO without compromising the other performance parameters of the LDO.

A small value of the load capacitor $C_L$ (103) in low-load-capacitor LDO proportionally increases the dominant load pole frequency $P_1$ (equation 1.1A) and the unity gain frequency (equation 1.6). At a full load current, the second pole $P_2$ (equation 1.3) protrudes into the unity gain frequency (UGF, equation 1.6) and degrades the stability when frequency compensation method of prior art 1 is applied in case of the low-load-capacitor regulator compensation.

Additionally, a low value of the load capacitor $C_L$ (103) introduces a wide variation in the dominant load pole $P_1$ due to a change in load current $I_L$ (equation 1.1C and 1.1D) and at a maximum load current the dominant load pole $P_1$ increases to such a high frequency that, in addition to $P_2$, the parasitic pole $P_3$ or $P_4$ (equation 1.4A or 1.4B) occurs very near to the UGF or may fall within the UGF (equation 1.6) and stability margin of the LDO (100) becomes very low at the higher load current range for prior art 1.

Moreover, the ESR (104) of an on-chip capacitor is too small (comes from routing and via resistance) to consider and for a small SM type external decoupling capacitors its value falls in such a low range that ESR zero $Z_{ESR}$ (equation 1.2) lies at much higher frequency than the UGF (equation 1.6), which can't be exploited for cancellation of second pole $P_2$ (equation 1.3) as is done for prior art 1. So, the compensation strategy adopted in prior art 1 no longer holds good for the low-load-capacitor regulators suitable for the SoC applications.

New compensation methods for the low-load-capacitor LDO are urgently required to keep pace with the current SoC trends. The compensation strategy must be such that the regulator consumes low power, and provides a good phase margin over zero to full load current range (for good transient response over the full load current range) using a load capacitor in the range of a few nano-Farads to a few hundreds of nano-Farads.

FIG. 2 describes a block diagram for a LDO 200 according to U.S. Pat. No. 6,603,292 (prior art 2) Prior art 2 includes a load capacitor (203) with a value of 470 nano-Farad and an adaptive zero frequency circuit is incorporated to achieve a stability for a limited load current range for the LDO 200.

In prior art 2, a dominant pole $P_1$ is realized at the regulator's (200) output node 208 and has the similar expressions as given by equations 1.1A to 1.1D.

An adaptive zero $Z_C$, is introduced within its unity gain frequency in the loop transfer function, which can be approximated by $$Z_C = \frac{-1}{R_{DS} \times C_C} \tag{2.1}$$

where $R_{DS}$ is a drain-source ac resistance of an NMOS transistor 216 and $C_C$ is the compensation capacitor 217.

The ESR zero has been neglected in prior art 2 as it uses 470 nano-Farad ceramic capacitor (203) with a low ESR (204) of nearly 10 mΩ, which produces a very high frequency ESR zero (nearly $3.3\times10^7$ Hz).

In addition to $Z_C$ (equation 2.1), a pole is also created at node 219 and its frequency can be approximated by $$P_{par} = \frac{-(C_c + C_{par})}{R_{DS} \times C_c \times C_{par}} \tag{2.2}$$

where $C_{par}$ is the parasitic capacitance at the node 219 except $C_C$ and is mainly contributed from an input capacitance of the voltage buffer 210. When the value of $C_{par}$ is not much less than $C_C$ (217), then the zero $Z_C$ (equation 2.1) is cancelled by the pole $P_{par}$ (equation 2.2) itself and $Z_C$ can't be utilized in the stability compensation effectively.

Additionally, node 218 of the LDO 200 contributes another pole approximately at $$P'_{par} = \frac{-G_{O.BUFF}}{C'_{par}} \tag{2.3}$$

where $G_{O.BUFF}$ is an output conductance of the voltage buffer 210 and $C'_{par}$ is the total parasitic capacitance at the node 218, which is mainly contributed from the gate capacitance of the large PMOS driver transistor 220.

Another pole originates according to equation 1.4B (though it can be neglected as ESR is very low) and implies that the LDO 200 has also to be considered with respect to these four poles.

It is observed in prior art 2, that the $Z_C$ (equation 2.1) stops the −20 dB/decade gain fall due to $P_1$ (equation 1.1A), and the residual gain falls below a unity gain with the help of one of these two poles (may be $P'_{par}$ from equation 2.3 with the assumption $P'_{par}<P_{par}$) or may be with the help of the other parasitic pole too ($P_{par}$, equation 2.2) depending on the amount of residual gain and the separation between these parasitic poles ($P'_{par}$ & $P_{par}$) occurring at node 218 and 219 of the LDO 200. When these parasitic poles (2.2 and 2.3) are not very far away from each other, then they produce a local phase dip with a poor phase margin for the LDO 200 in case of the compensation method of prior art 2.

More over, as the maximum consumption limits the maximum reflection current through the NMOS transistor 215 at a full load condition, therefore at a small load current the reflection current through the NMOS transistor 215 becomes very small which increases the $R_{DS}$ of the NMOS transistor 216 to a very high value and correspondingly decreases the adaptive zero frequency ($Z_C$ in equation 2.1), which can be small enough to create a stability problem due to an early gain halt. The result shows that a phase margin with a load resistance 280 KΩ is only 22° at 7 dB open-loop gain and few degrees at a unity gain frequency. This small phase margin makes the transient response oscillatory in nature and demands a long settling time. Additionally, a smaller phase margin produces a bigger transient peak, which may cross a maximum voltage limit for the safe operation of the load circuits.

In addition, as the LDO 200 includes an external load capacitor (203) (of 470 nano-Farad capacitance value) and compensated with dominant load pole ($P_1$, equation 1.1A) frequency compensation, therefore the unity gain frequency at maximum load current becomes of the order of several MHz. When a bond inductance 207 (which is several nanohenries and largely depends on the package used for a particular application) is included, the stability of the LDO 200 having a large bandwidth (several MHz) may be severely affected. This inductance introduces an additional zero on the top of a loop transfer function, which is not very far away from UGF of an LDO having a very high bandwidth. This extra zero further enhances the unity gain frequency and degrades the phase margin. The additional zero frequency can be dampened out by adding extra bypass capacitors. But this introduces a pair of closely-spaced complex poles, which creates a resonant notch in the magnitude as well as phase response curve of an LDO. Although the phase margin may be slightly improved, the response becomes unstable as it is on the edge of a very sharply changing phase response. This problem is removed for the LDO using a large external decoupling capacitor with bigger ESR, which limits the bandwidth of LDO to few MHz and ESR increases the damping of the LC tank circuit too. In case of prior art 2, the bandwidth continues to increase with increasing load current due to an increase in the dominant load pole $P_1$ frequency (equation 1.1C & 1.1D).

The problem can be solved if the frequency compensation can be achieved by means of any internal node dominant pole rather than the dominant load pole at the output of the LDO 200. In that case the dominant internal pole frequency variation must be much lesser with the load current variation and second pole of the LDO 200 may be cancelled with a zero realized in the transfer function. Added advantage can be gained if the zero can track the variation in the second pole with a load current.

FIG. 3 describes the block diagram of an LDO 300 according to U.S. Patent Application Publication No. 20050127885 (prior art 3). Prior art 3 proposes another method for realizing an on-chip LDO (300) with a load capacitor $C_L$ (303) (of approximately 1.225 nano-Farad) due to a load circuitry, which the LDO 300 is driving.

The open loop transfer function for LDO 300 can be expressed as follow $$\frac{V_{out}(S)}{V_{in}(S)} = \frac{-G_{mI}G_{mII}R_I R_{II}(R_Z + SC_C)}{(1 + mS)(1 + pS + qS^2)} \tag{3.1}$$

where $G_{mI}$, $G_{mII}$; $R_I$, $R_{II}$, and $R_Z$ are the transconductance of an error amplifier 312 and transconductance of a driver PMOS transistor 310; an output impedance of the error amplifier 312, impedance at node 308 and the output impedance of the voltage buffer 350, respectively. $C_C$ is the compensation capacitor 306.

The coefficients p and q of the second factor in the denominator of equation 3.1 can be expressed as $$p = \left(\frac{1}{P_2} + \frac{1}{P_3}\right) \tag{3.2}$$

and $$q = \frac{1}{P_2 P_3}$$

where $P_2$ & $P_3$ in equation 3.2 are second and third poles in the loop transfer function 3.1, respectively.

The dominant pole occurs at node 311 due to a miller multiplication of the capacitor $C_C$ (306) across a second gain stage, which is the PMOS driver transistor 310, and the dominant pole frequency can be approximated by $$P_1 = \frac{-1}{m} \cong \frac{-1}{R_I \times (G_{mII} R_{II} \times C_C)} \tag{3.3}$$

The transfer function in 3.1 has a left half S-plane zero approximately at $$Z_C = \frac{-1}{R_Z C_C} \tag{3.4}$$

where, $R_Z$, is the output impedance of the source follower 350.

The second factor in the denominator of equation 3.1, which contributes two poles in the open-loop transfer function, has a damping factor given by $$\xi = \frac{1}{2} \times \sqrt{\left(\frac{C_L}{C_I}\right) \times \frac{1}{G_{mII} R_Z}} \tag{3.5}$$

where $G_{mII}$ is a transconductance of the PMOS driver transistor 310 and is proportional to the square root of the load current $I_L$ (305), assuming the drain current of the PMOS driver transistor 310 is mainly contributed by the load current $I_L$ (305). The $C_L$ (303) is the load capacitance at node 308 and $C_I$ is the total node capacitance at node 311 except $C_C$. $C_I$ is mainly contributed from a gate capacitance of the large PMOS driver transistor 310. Except $G_{mII}$ other variables in equation 3.5 are independent of the load current $I_L$ (305). So, the damping factor can be expressed as $$\xi \propto \frac{1}{\sqrt[4]{I_L}} \tag{3.6}$$

$P_2$ and $P_3$ in the LDO 300 becomes real at low load current ($I_L$) range when the damping factor (equation 3.5 & 3.6) is greater than one and their frequencies can be approximated by $$P_2 = \frac{-G_{mII}}{C_L} \tag{3.7}$$

-continued $$P_3 = \frac{-1}{R_Z C_I} \tag{3.8}$$

With the increase in load current $I_L$ (305), when the value of the damping factor (equation 3.5) becomes less than one then these two poles form a pair of complex conjugate poles. Equation 3.7 states that with the increase of load current the lower frequency pole $P_2$ continuously increases due to square root proportionality of $G_{mII}$ with load current $I_L$ (305) and higher frequency pole $P_3$ (equation 3.8) decreases with load current $I_L$ (305) as gate capacitance of 310 increases (increasing $C_I$ in equation 3.8) with increasing load current. At higher load current when damping factor (equation 3.5) becomes less than one, the second and third poles combine and form a pair of complex conjugate pole. In prior art 3 the values of the $C_C$ and the $C_I$ are such that this complex pole pair generally occurs after the zero $Z_C$ (equation 3.4) at higher load current range.

When the zero $Z_C$ (equation 3.4) protrudes into the UGF, then −20 dB/decade fall in the gain by $P_1$ (equation 3.3, this dominant pole is not at very low frequency due to limited value of on-chip $C_C$ and moderate gain of the driver) is stopped and residual gain is diminished with the help of this complex pole pair as shown in FIG. 9 through the simulated Bode plot of prior art3 (with a resistance in series with $C_C$ 306 as explained latter on). Phase margin is degraded due to a sharp change in the phase from a complex pole pair and results in a damped oscillation in the transient settling response.

The natural frequency for the complex conjugate pole pair is given by $$P_n = \frac{G_{mII}}{C_L R_Z C_I} \tag{3.10}$$

In prior art 3 these complex poles are obtained at higher frequency (equation 3.10) when a very small load capacitor is considered ($C_L$ in prior 3 is 1.225 nano-Farad). Also the zero $Z_C$ (equation 3.4) in prior art 3 is much greater than the unity gain frequency due to a small value of $R_Z$. Hence given to above condition of very low load capacitor value prior art 3 shows a good phase margin.

Unfortunately, as previously pointed out that lower the load capacitor value, larger is the voltage peak and trough during the quick transient load current change. LDO required to have infinitely high bandwidth to respond to these instantaneous load current spikes which is not possible for a stable LDO. When transient trough becomes less than the lower limit of controlled output voltage it may hamper the operation of the load circuitry temporarily, but if the transient voltage peak crosses the safe operating area (SOA) of load circuitry it can burst out the gates of the load circuits and may be responsible for permanent failure of the chip.

To avoid this fatal trouble we conventionally add a few on-chip decoupling capacitors (if possible small SM type off-chip decoupling capacitor is also added when off-chip area constraint does not allow large sized external capacitors) and do not depend only on the default chip capacitance to smoothen out this transient peak and trough. Accordingly, when load capacitor $C_L$ (303) becomes several tens to hundreds of nano-Farads, the complex pole pair frequency falls within UGF at higher load current degrading the phase margin badly due to sharp phase change offered by the complex pole pair.

In addition, the phase margin at low load current also deteriorates as shown in FIG. 10 (figure titled as prior art 3 without $R_C$). This is due to the fact that a second pole frequency $P_2$ (equation 3.7, when $P_2$ and $P_3$ becomes real) decreases with the decreasing load current (as $G_{mII}$ in equation $3.7 \propto \sqrt{I_L}$) and falls within the UGF at low load current range for a considerable load capacitance $C_L$ (303) required for a safe transient behavior. The power management in battery operated portable consumer products includes a standby mode of operation when the full activity of the chip is not required. During this standby mode, current requirement of the chip is minimal and its value varies from hundreds of microampere to a few milliamperes depending on the application. So, prior art 3 topology does not hold good in this low consumption mode operation when an LDO has to supply a small load current.

The phase margin at a low current range can be improved, for prior art 3, by inserting a resistor ($R_C$) in series with the capacitor $C_C$ (306). In this case, $R_Z$ in equation 3.4 is increased by this added series resistance ($R_C$) and thus the zero frequency $Z_C$ (equation 3.4) can be decreased to lower frequency to improve the phase margin at low load current range. Unfortunately, an increase in the value of $R_Z$ decreases the complex pole frequency (equation 3.10) as well and thus the phase margin at a higher load current range is degraded as shown in the FIG. 10 (figure titled as prior art 3 with $R_C$ in series with $C_C$).

Phase margin at a low load current range in prior art 3 can also be improved by further increasing the value of the on-chip compensation capacitor $C_C$ (306) to lower the dominant pole frequency $P_1$ (equation 3.3), so that the gain falls below unity solely with the help of this dominant pole $P_1$ before the second load $P_2$ (equation 3.7) pole occurs. But, it demands a fairly large value for the compensation capacitor $C_C$ (306) and hence a large chip area.

On the other hand, a constant sink current can be drawn from the PMOS driver 310, so that even at no load current the second pole frequency $P_2$ (equation 3.7) occurs after UGB and at least 45° phase margin can be obtained at no load condition. But this constant sink current is added to the consumption of the LDO 300, which is specifically needed to be consumed in the low load current region, which increases the consumption in the standby operation.

Finally, when an input supply 313 is much greater than the regulated output voltage of the LDO 300, the variable capacitor 306 never leaves the accumulation region and variation in the capacitance of $C_C$ (306) with a load current ($I_L$) becomes negligible. On the other hand, when the input supply 313 is near to the output voltage (maintaining only the dropout voltage) of the LDO 300, the capacitor $C_C$ (306) always operates in the depletion region and thus similar variation in the capacitance of the voltage dependence capacitor $C_C$ (306) with the load current is not be obtained for varying input power supply (313) range.

The damping factor (equation 3.5) of the above mentioned complex pole pair can be controlled by a damping factor control (DFC) block and the complex pole pair can be cancelled with the help of two zeros according to U.S. Patent Application Publication No. 20040164789. One zero is associated with the ESR of the off-chip capacitor and another one realized from the lead compensator in the feedback network. Although for low-load-capacitor LDO with negligible ESR and LDO having controlled output voltage near to reference voltage (for sub-100 nm low voltage CMOS circuits), one cannot utilize these two zeros efficiently for pole-zero cancellation and problem persists. Additionally, designer has to meet stringent mathematical equalities, which may not be achievable in all process corners. Also the complex poles due to load capacitance are ignored in case of an on-chip LDO. Stability at no load for the on-chip LDO is achieved by drawing a constant sink current from the PMOS driver transistor. As already mentioned, this method of sinking a constant load current to achieve stability at no load is not a good low power solution.

Thus, there is an urgent need for a robust LDO compensation technique, which works equally fine for a load capacitor ranging from a few nano-Farads to a few hundreds of nano-Farads and provides fairly good phase margin over no load to a certain maximum load current with low power consumption. More over, added advantage can be obtained if the performance of the compensation circuits does not critically dependent on satisfying some rigorous mathematical equality which may not be achievable in all the process corners and other performance parameters of the LDO should not be critically affected.

SUMMARY OF THE INVENTION

It is an object of the present invention to provide a good phase margin for a low dropout voltage regulator (LDO) over no load to a certain maximum load current.

It is another object of the present invention to stabilize an (LDO) driving a low-load-capacitor suitable for safe dynamic load switching response in system on chip (SoC) application.

It is yet another object of the present invention to minimize the power consumption of the low-load-capacitor LDO.

It is a further object of the present invention to stabilize the LDO in unity as well as non-unity feedback configurations.

Another object of the present invention is to stabilize the LDO without utilizing the equivalent series resistance (ESR) zero.

To achieve said objectives, the present invention provides a low drop out voltage regulator (LDO) that receives an input supply voltage at the input terminal and provides a regulated output voltage at the output terminal, the LDO comprising an error amplifier responsive to a difference between a predetermined reference voltage and a function of the output voltage to produce an error signal, a driver transistor responsive to said error signal to adjust the current to the output load and reduce the error signal, an NMOS current sink transistor having its drain connected to the output terminal of said LDO, a load capacitor connected to the output terminal of said LDO, and a stability compensation circuit. The stability compensation circuit includes a source follower having an input terminal connected to the output terminal of said LDO to provide a small signal gain nearly equal to one from its input to output terminal with a dc output voltage being lower than a dc input voltage, a resistor having a first terminal connected to an output of said source follower, a voltage dependent compensation capacitor having an negative terminal connected to a second terminal of said resistor, and a positive terminal connected to the output of said error amplifier, wherein said capacitor remains in an accumulation region at no load current to provide a maximum capacitance, and the capacitance of said capacitor decreases with a load current during a depletion region operation at higher load current region, and a parasitic pole reshaping PMOS transistor operating in a saturation region having a gate connected to the output of said error amplifier, a source connected to said input power supply, and a drain connected to the negative terminal of said capacitor.

BRIEF DESCRIPTION OF THE DRAWINGS

The present invention is described with the help of accompanying drawings.

DETAILED DESCRIPTION OF THE INVENTION

The present invention provides a stability compensation circuit for an LDO driving a load capacitor in a range of few nano-Farads to few hundreds of nano-Farads with a good phase margin over a no load to full load current range, and maintains minimum power area product for an LDO suitable for a SoC integration.

Figure 1:
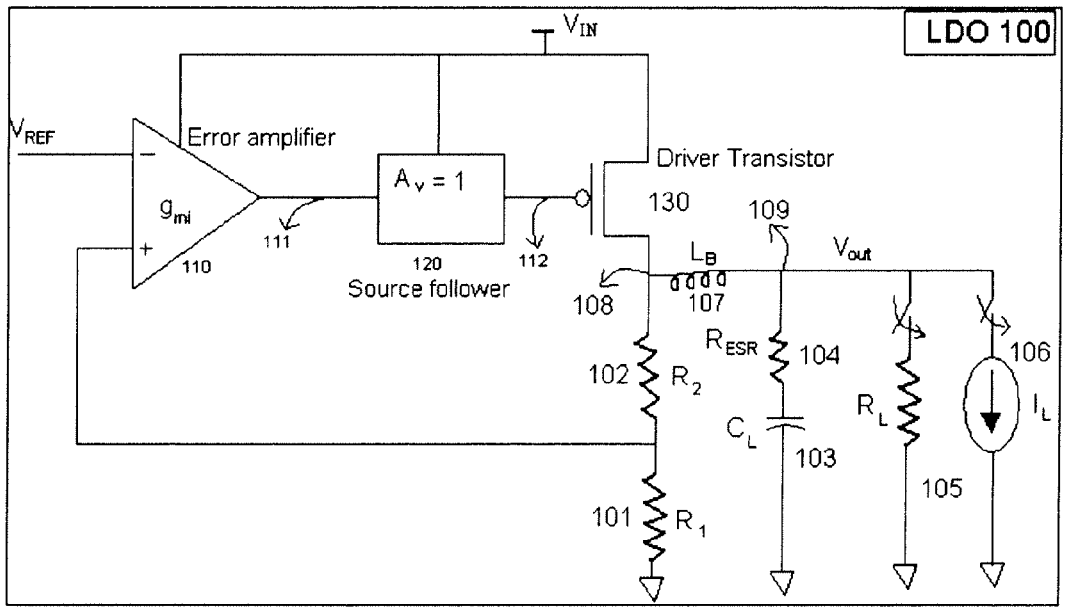
FIG. 1 PRIOR ART
FIG. 1 describes the block diagram of a conventional LDO according to prior art 1.
Figure 2:
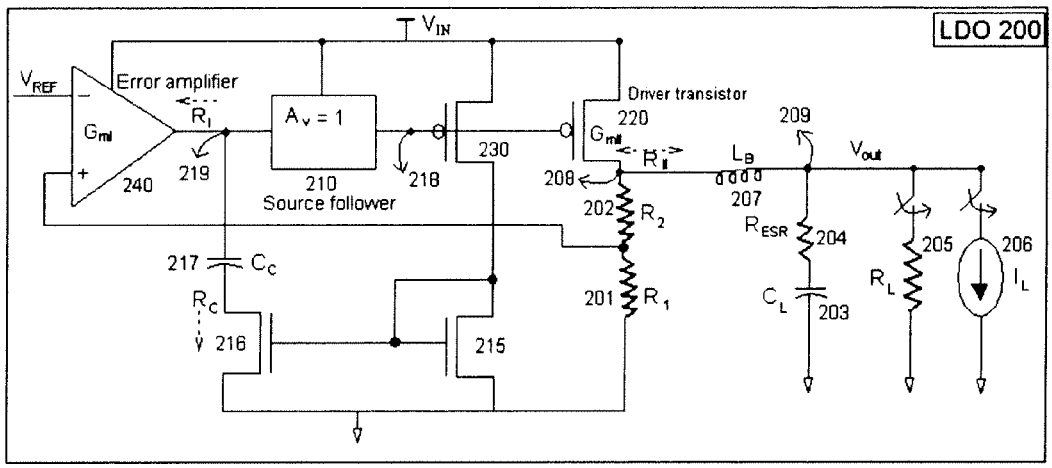
FIG. 2 PRIOR ART
FIG. 2 describes the block diagram of an LDO according to an embodiment of prior art 2
Figure 3:
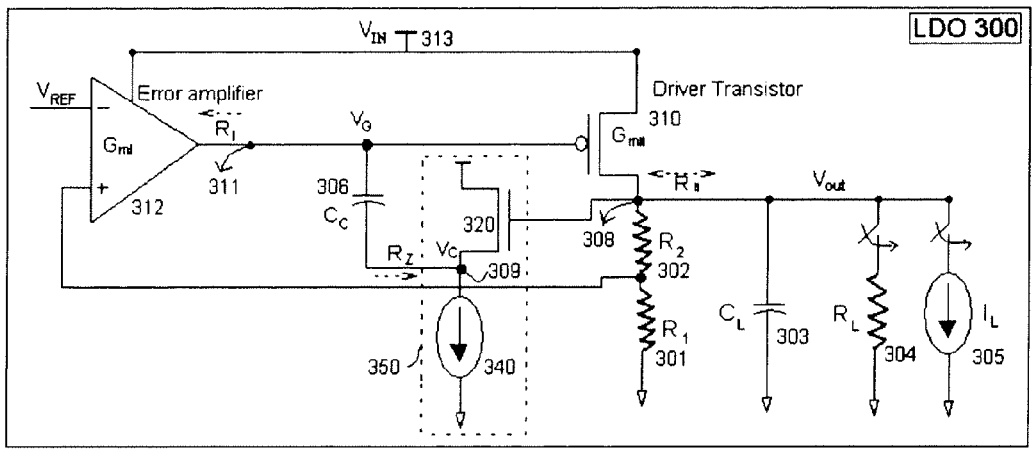
FIG. 3 PRIOR ART
FIG. 3 describes the block diagram of an LDO according to an embodiment of prior art 3.
Figure 4:
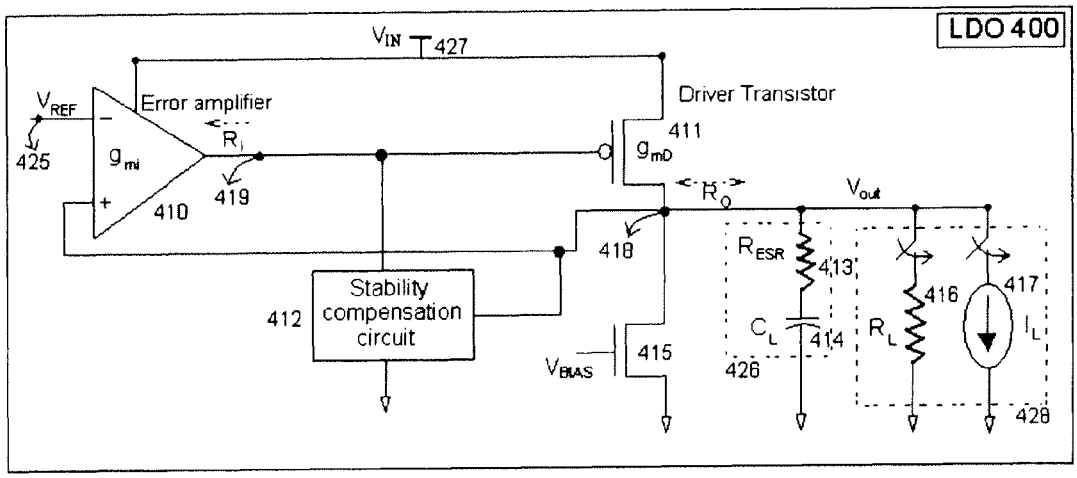
FIG. 4 describes a block diagram of an LDO according to an embodiment of the present invention.

FIG. 4 describes a block diagram of an LDO 400 according to an embodiment of the present invention.

Figure 5:
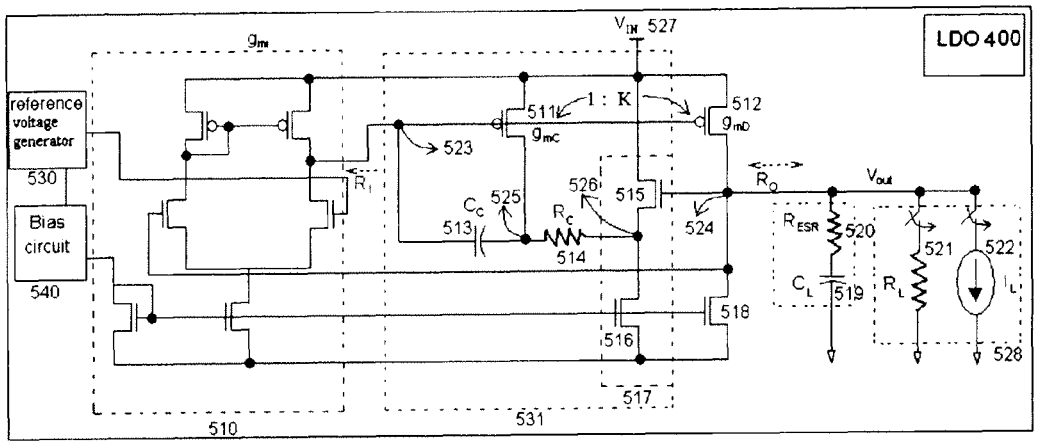
FIG. 5 describes a schematic diagram of an LDO according to an embodiment of the present invention.

FIG. 5 shows a schematic diagram of an LDO (400) according to an embodiment of the present invention. The present LDO (400) can be considered as a two stage amplifier. The first stage 510, which is a differential to single ended differential amplifier, compares a reference voltage generated from a reference voltage generator circuit 530 with a regulated output voltage at node 524 of the LDO 400. The reference voltage and the regulated output voltage are connected to a negative and a positive terminal of an error amplifier 510 with respect to the output (node 523) of the error amplifier 510, respectively. The second stage is a driver transistor 512 working in a saturation region and provides a load current ($I_L$) from an input power supply (527) to a load circuit 528. In an embodiment of the present invention the driver transistor 512 is a PMOS transistor operating in a saturation region. A load capacitor $C_L$ (519) may either consist of a chip capacitance or a local on-chip decoupling capacitor. For a better decoupling a small external decoupling capacitor may also be added. For an embodiment of the present invention, the load capacitor 519 consisting of a 100 nF (+/−10% variation) external SM type capacitor and 120K equivalent gate chip capacitance. In this embodiment, the LDO (400) works as a closed loop system with a negative feedback in a unity feedback configuration. A stability obtained in the unity feedback also confirms the stability in a non-unity feedback. So, the present architecture for LDO 400 can be used for non-unity feedback configuration too. An NMOS transistor 518 is connected at an output to sink the leakage current flowing through the large driver transistor (512). Otherwise, at no load the driver transistor 512 is off and the loop being open. The leakage current flowing from the large driver pulls the output of the LDO 400 up to the input supply (527) level and can cause damage to the load circuitry. For non-unity feedback the NMOS transistor 518 can be replaced by two big resistors with values in intended ratio.

The frequency compensation circuit 531 includes a voltage dependent compensation capacitor $C_C$ (513) having a positive terminal is connected with the node 523 and a negative terminal is connected with the node 525 ($n^+$poly-n well in this embodiment, in general it can be realized with poly-well capacitor, MOS capacitor etc), a parasitic pole frequency reshaping PMOS transistor 511 working in a saturation region, a variable potential generator cum nulling resistor $R_C$ (514) and a source follower 517 and their interconnections are shown in FIG. 5.

The operation of the frequency compensation circuit 531 depends on its large signal as well as on its small signal behavior.

Figure 6:
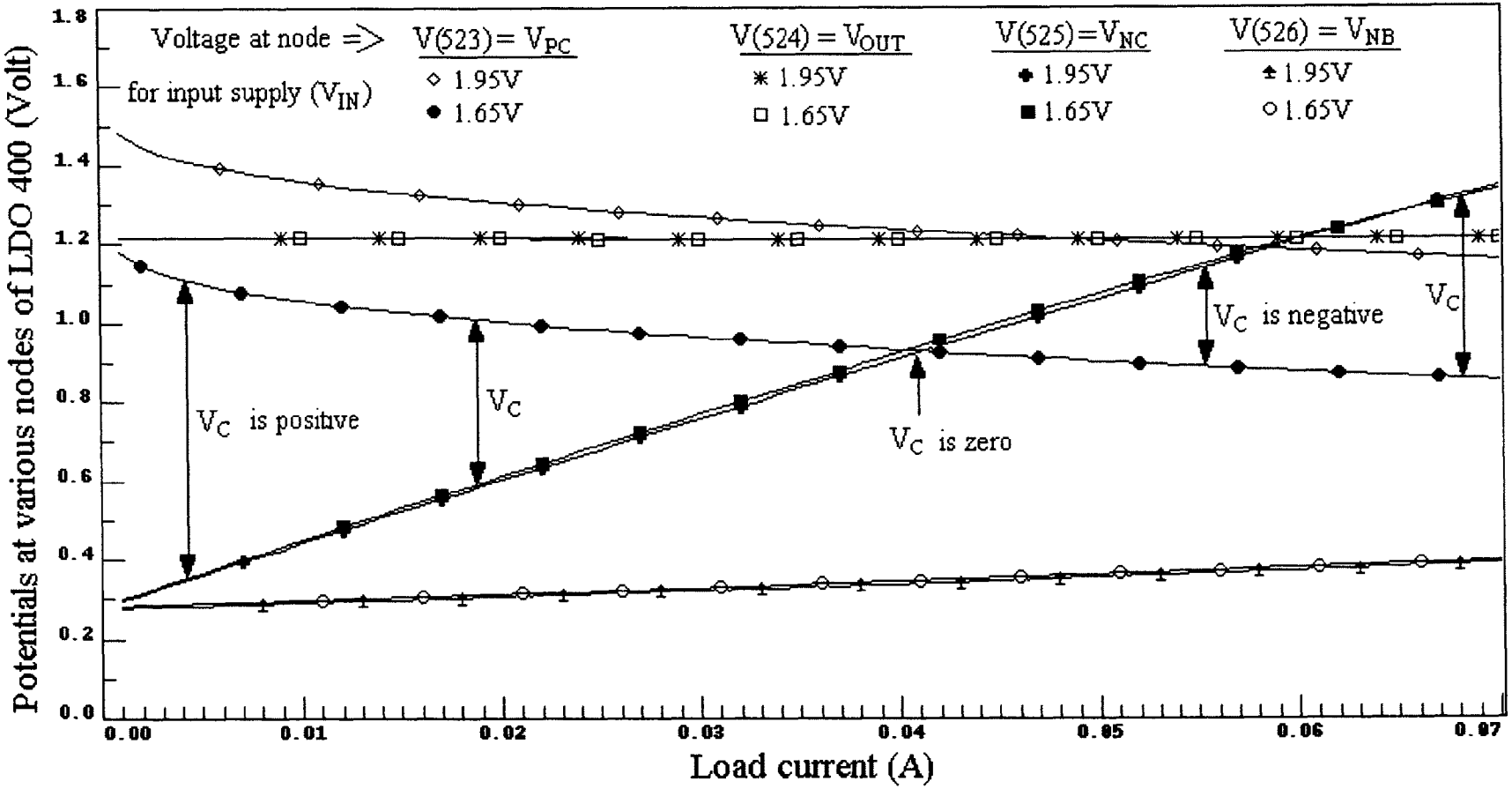
FIG. 6 illustrates the simulated potential variations of various nodes of the regulator with load current and supply voltage according to an embodiment of the present invention.

Large signal analysis goes as follows:

The n-well terminal (node 525) potential of $C_C$ (513) can be expressed as $$v_{NC}=v_{NB}+R_C\times I_{D.511} \tag{4.1}$$

where $v_{NB}$ is the potential at the node 526 and $I_{D.511}$ is the drain current flowing through the PMOS transistor 511. FIG. 6 shows the simulated variation of $v_{NC}$ and $v_{NB}$ with a load current ($I_L$) for two extreme values (1.65V and 1.95V) of a 1.8V compatible battery voltage.

$v_{NB}$ is one gate-source voltage ($V_{GS.515}$ of the NMOS transistor 515) below the controlled output voltage ($v_{OUT}$) at node 524 as shown in FIG. 6 and can be given by $$v_{NB}=v_{OUT}-v_{GS.515} \tag{4.2}$$

The PMOS transistor 511 is connected in a mirror configuration with the PMOS driver transistor 512 with a W/L ratio 1:K. Thus the drain current ($I_{D.511}$) through PMOS transistor 511 can be given by $$I_{D.511} = \frac{1}{K}\times I_L \tag{4.3}$$

where $I_L$ (522) is the load current flowing through the PMOS driver transistor 512 (neglecting the small bleed current drawn by NMOS transistor 518 with respect to the load current)

Combining the equations 4.1 to 4.3, we get the nwell terminal (node 525) potential of the compensation capacitor $C_C$ (513) as $$v_{NC} = (v_{OUT} - v_{GS.515}) + \frac{1}{K}R_C I_L \tag{4.4}$$

The potential at the poly terminal (node 523) of the compensation capacitor $C_C$ (513) can be given by $$v_{PC}=v_{IN}-v_{SG.512}=v_{IN}-(\sqrt{2I_L/\beta}+|V_{TH.512}|) \tag{4.5}$$

where $v_{IN}$ is the input power supply (527) to the LDO 400, $V_{SG.512}$ and $V_{TH.512}$ are the gate source voltage and threshold voltage of the PMOS driver transistor 512, respectively. β is the device transconductance parameter of the PMOS driver transistor 512 and is the product of its W/L ratio, channel hole mobility and the gate capacitance of unit area.

From equations 4.4 and 4.5 the voltage across the capacitor $C_C$ (513) is $$v_C = v_{PC} - v_{NC} = \begin{bmatrix} (v_{IN} - v_{OUT}) + \\ v_{GS.515} \end{bmatrix} - \begin{bmatrix} |V_{TH.512}| + \\ \frac{1}{K} R_C I_L + \sqrt{2I_L/\beta} \end{bmatrix} \quad (4.6)$$

Figure 7:
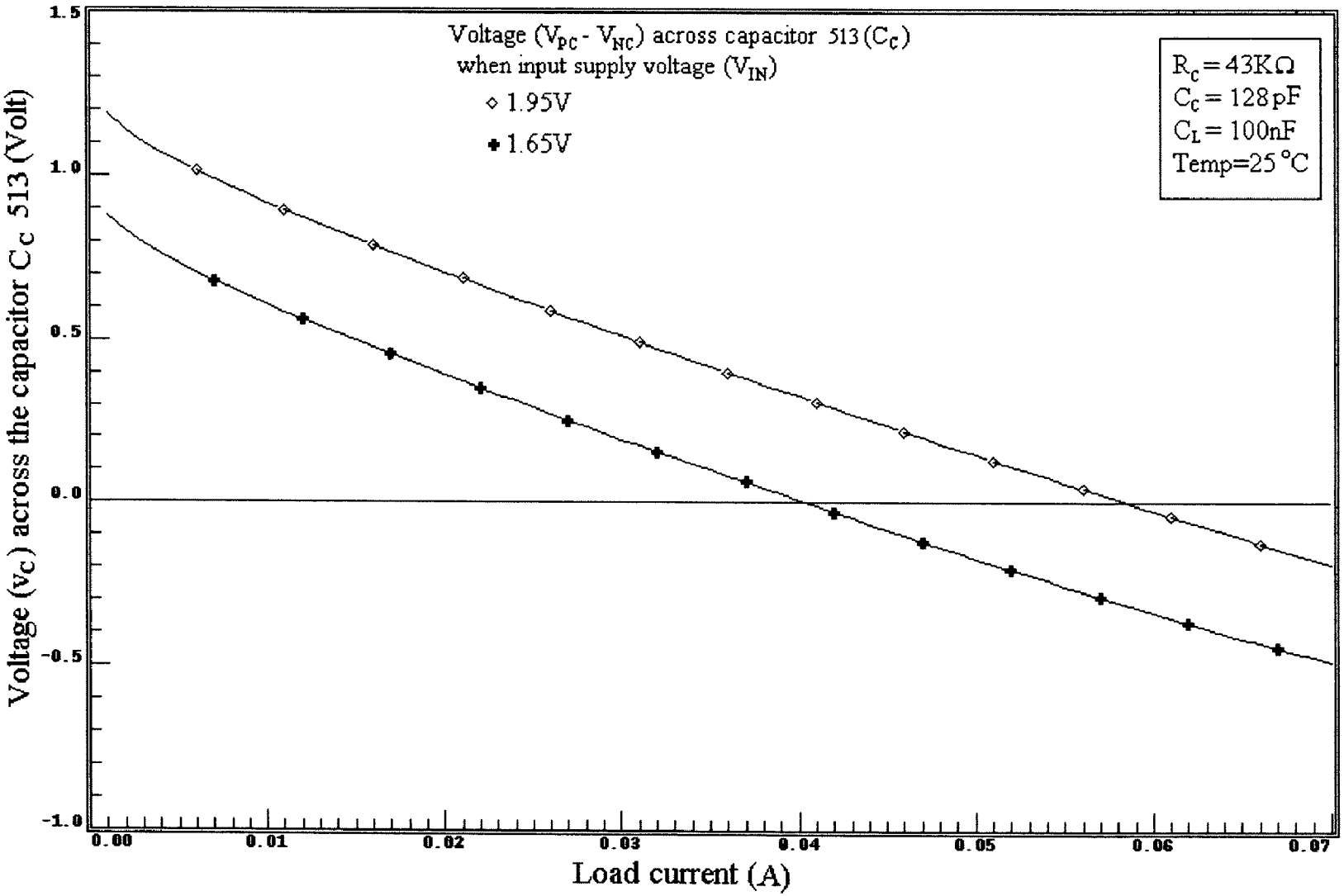
FIG. 7 illustrates the simulated variations in the voltage across the compensation capacitor with load current and supply voltage according to an embodiment of present invention.

From equations 4.6 it is observed that the voltage ($v_C$) across the capacitor $C_C$ (513) is a function of the load current ($I_L$), a nulling resistance $R_C$, a reflection factor K, the input supply voltage ($v_{IN}$), the controlled output voltage ($v_{OUT}$) and the gate source voltage $v_{GS.515}$. The simulated variation of the voltage ($v_C$) across the voltage dependent $n^+$poly-nwell compensation capacitor $C_C$ (513) with a load current for two extreme values (1.65V and 1.95V) of a 1.8V compatible battery is shown in FIG. 7. Voltage across the capacitor decreases from nearly 1V to −0.4V when load current is increased from zero to 70 mA as shown in FIG. 7. This variation in the voltage ($v_C$) across the capacitor $C_C$ (513) modifies its capacitance value from accumulation capacitance to depletion capacitance with increasing load current and provides a way to modify a zero frequency in the loop transfer function that tracks the second pole in the loop transfer function.

Therefore, by choosing proper values of reflection ratio K, the nulling resistance $R_C$ (514) and gate source voltage $v_{GS.515}$ of NMOS transistor 515 for a particular $v_{OUT}$ (at node 524) and $v_{IN}$ (527) combination the voltage across the compensation capacitor $C_C$ (513) can be varied from accumulation region at small load current to depletion region at full load current. A full variation in the voltage dependent compensation capacitor (poly-nwell, MOS capacitor) can be obtained by maintaining the relations given by equations 4.7 and 4.8.

$$v_{C.I_L=0} = v_{PC} - v_{NC} \cong \{(v_{IN} - v_{OUT}) + v_{GS.515}\} > V_{fb} \quad (4.7)$$

Figure 8:
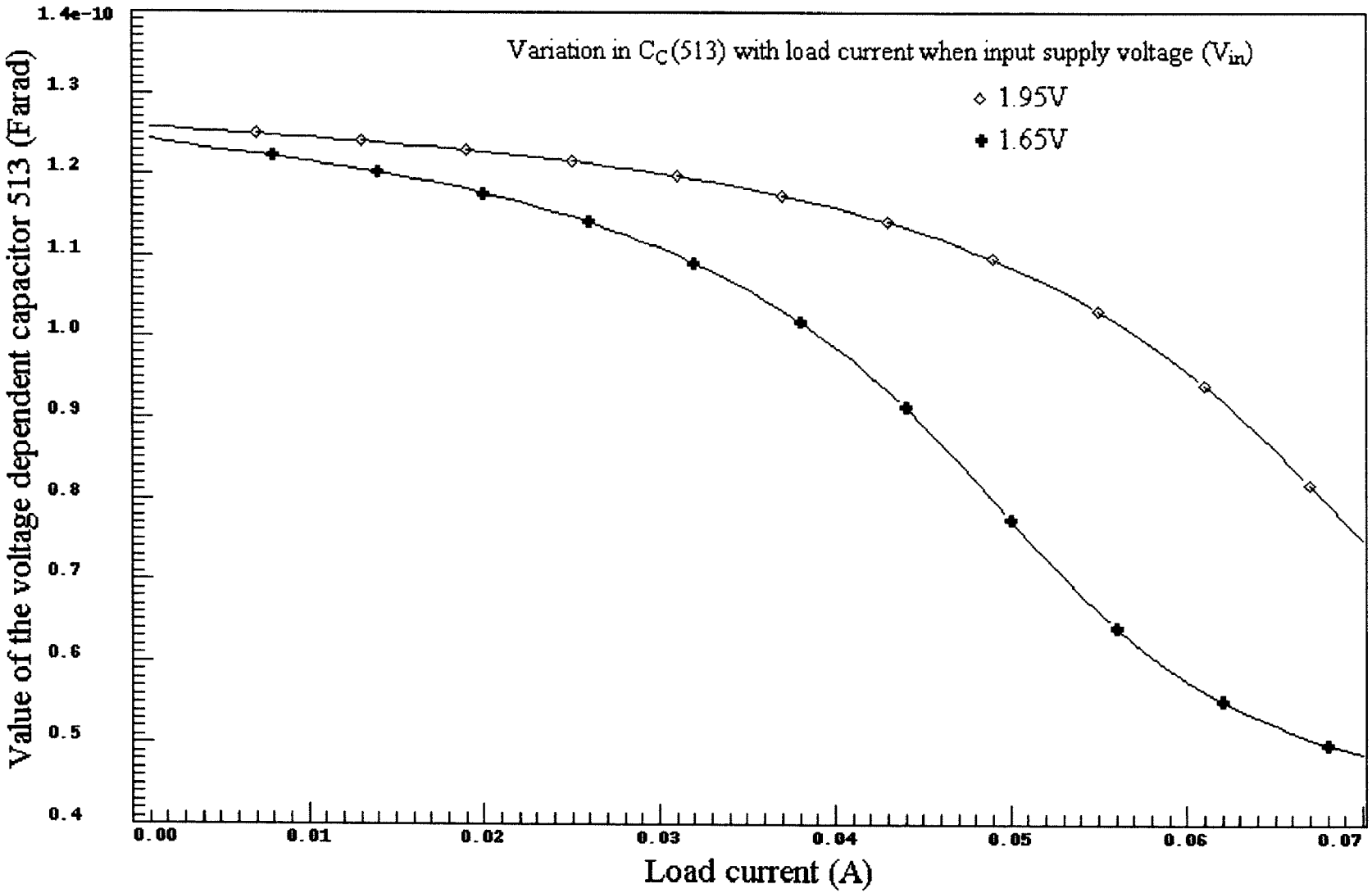
FIG. 8 illustrates the simulated variations in the capacitance value of the voltage dependent compensation capacitor with load current and supply voltage according to an embodiment of present invention.

For an $n^+$poly-nwell compensation capacitor $C_C$ (513), when voltage across it becomes greater than its flat band potential ($V_{fb}$, which is a positive quantity) the capacitor enters into accumulation region. When voltage across the capacitor falls below its flat band potential it starts to enter into the depletion region. At maximum load current the fall in the voltage across the capacitor $C_C$ (513) must stop before the start of inversion for the capacitor and can be represented by $$v_{C.I_{Lmax}} > V_{th.cap} \quad (4.8)$$

where $V_{th.cap}$ (is a negative quantity in this case) is channel inversion voltage for the voltage dependent capacitor. The simulated variation in the capacitance of $C_C$ (513) is shown in FIG. 8 for two extreme values (1.95V and 1.65V) of a 1.8V compatible input battery voltage 527 ($v_{IN}$) over no load to full load current sweep. The capacitance $C_C$ (513) decreases with increasing load current $I_L$ (522) in a similar fashion for both the extreme supply values. The compensation capacitor $C_C$ (513) departs from accumulation (providing maximum capacitance value) at no load to depletion region (providing minimum capacitance value) at full load both for the two extreme values of supply. This has been possible due to the fact that potentials at both terminals of the capacitor $C_C$ (513) are modified with the load current $I_L$ (522). Introduction of the PMOS transistor 511 and the nulling resistor $R_C$ (514), in this invention, gives a way to vary the voltage $v_C$ across the capacitor $C_C$ (513) according to equation 4.6 and satisfying conditions 4.7 & 4.8 while keeping the PMOS driver 512 and PMOS transistor 511 in saturation to modify a zero frequency with load current $I_L$ (522).

The small signal analysis for the present LDO 400 goes as follows:

The open loop transfer function for the present LDO (400) can be approximated by $$H(S) = \frac{V_o(S)}{V_{in}(S)} = \frac{-g_{mi} g_{mD} R_I R_O (1 + SR_C C_C)}{(1 + S g_{mD} R_O R_I C_C)\left(1 + S\frac{(g_{mC} + G_I) R_C C_L}{g_{mD}} + S^2 \frac{R_C C_L C_{par}}{g_{mD}}\right)} \quad (4.9)$$

where $g_{mi}$, $g_{mD}$, $g_{mC}$ are transconductance of the error amplifier 510, transconductance of the driver PMOS transistor 512 and transconductance of PMOS transistor 511, $R_I$ (=1/$G_I$) is the output impedance of the error amplifier 510, $R_C$ (=1/$G_C$) is the nulling resistance 514, $R_O$ is the total impedance at the output node 524, and $C_L$, $C_C$ and $C_{par}$ are the load capacitor 519, the voltage dependent compensation capacitor 513 and the total parasitic capacitance at node 523, respectively. The capacitance $C_{par}$ is contributed mainly by the gate capacitance of large PMOS driver transistor 512.

Equation 4.9 implies that the low frequency gain of the LDO (400) is $$A_{v0} = g_{mi} g_{mD} R_I R_O \quad (4.10)$$

Due to miller multiplication of $C_C$ (513) across the second stage (the PMOS driver 512) of the LDO (400), the first pole in the transfer function is generated at the output (node 523) of the error amplifier 510 at a frequency approximated by $$P_1 = \frac{-1}{g_{mD} R_O R_I C_C} \quad (4.11)$$

A left half S-plane zero is also created in the loop transfer function of LDO 400 at a frequency approximately given by $$Z_C = \frac{-1}{R_C C_C} \quad (4.12)$$

Here the compensation capacitor $C_C$ (513) decreases with the increasing load current ($I_L$) as explained in the previous large signal analysis. Therefore, the zero frequency ($Z_C$, in equation 4.12) increases with the increasing load current.

The second factor in the denominator of equation 4.9 gives another two poles in the loop transfer function. The damping factor for these two poles is given by $$\xi = \frac{(g_{mC} + G_I)}{2} \sqrt{\left(\frac{C_L}{C_{par}}\right) \times \frac{R_C}{g_{mD}}} \quad (4.13a)$$

The W/L ratio of the PMOS driver transistor 512 is K times than that of the PMOS transistor 511 and both the transistors operates in saturation region and connected in mirror configuration. Therefore, their transconductance $g_{mD}$ and $g_{mC}$ hold the following relation $$g_{mC} = \frac{1}{K} g_{mD} \tag{4.13b}$$

Both the transconductance $g_{mD}$ and $g_{mC}$ increased with the load current and at higher load current $g_{mC}$ becomes much greater than $G_I$. Then using 4.13a & 4.13b we get $$\xi = \frac{1}{2K} \times \sqrt{\frac{C_L}{C_{par}} \times g_{mD} R_C} \tag{4.14}$$

Comparing equation 4.14 for damping factor for the present invention with the equation 3.5 for damping factor in prior art 3, it is observed that damping factor of the present invention increases with load current with contrast to prior art 3, where it decreases with increasing load current.

Also it is noteworthy that in the present invention $\sqrt{g_{mD} R_C}$ has a proportionality relation with damping factor (in equation 4.14) instead of inverse proportionality relation of damping factor with $\sqrt{g_{mII} R_Z}$ (in equation 3.5) for prior art 3.

In addition, as $g_{mD} R_C >> 1$ (in equation 4.14), it makes the damping factor in 4.14 of the present invention always greater than 1 irrespective of the load current for the present invention.

So, the second factor in the denominator of 4.9 always gives two real poles which are the second ($P_2$) and third pole ($P_3$) in the loop transfer function and given by $$P_2 = \frac{-g_{mD}}{C_L} \times \frac{1}{R_C(g_{mc} + G_I)} \tag{4.15}$$

and $$P_3 = \frac{-(g_{mC} + G_I)}{C_{par}} \tag{4.16}$$

At $I_L$=0, $g_{mC}$ is much smaller than $G_I$ and equations 4.15 and 4.16 can be represented as $$P_2 = -\frac{g_{mD}}{C_L} \times \frac{R_I}{R_C} \tag{4.17}$$

and $$P_3 = \frac{-1}{R_I C_{par}}$$

The equation 4.17 sates that at no load current ($I_L$=0), the second pole ($P_2$ in equation 4.17) is increased by the ratio $R_I/R_C$ (which is a large quantity as $R_I >> R_C$) than its value for prior art 3 (equation 3.7). In this way the frequency of the second pole for the LDO 400 is reshaped to occur at higher frequency to improve the no load phase margin without drawing a constant sink current from the driver transistor and hence a low power LDO can be realized with the help of this compensation method. In addition, the zero $Z_C$ (equation 4.12) can be placed after the UGF to further improve the phase margin at small load current region.

On the other hand, with the increase in the load current $I_L$ (522) the second pole $P_2$ (equation 4.15) continues to increase due to the fact that $g_{mD}$ ($\propto\sqrt{I_L}$) in the numerator increases with the load current and third pole remains relatively constant as long as $g_{mC}$ is much smaller than $G_I$. The frequency of the zero $Z_C$ also increases (equation 4.12) with the increase in load current ($I_L$) due decrease in the capacitance of the capacitor $C_C$ (513). In this way the zero $Z_C$ (equation 4.12) tracks the second pole (equation 4.15) and a good phase margin is preserved with increasing load current ($I_L$).

When load current becomes large enough so that $g_{mC}$ is much greater than $G_I$ then the second and third pole frequencies can be given by $$P_2 = -\frac{g_{mD}}{C_L} \times \frac{1}{g_{mC} R_C} = \frac{K}{C_L R_C} \tag{4.18}$$

and $$P_3 = \frac{g_{mC}}{C_{par}}$$

The second pole ($P_2$, in equation 4.18) does not increase further with the load current. Increase in the zero frequency $Z_C$ (equation 4.12) also stops above a load current due to the fact that the compensation capacitor reaches its minimum value in the depletion region as shown in FIG. 8. By selecting a proper value of reflection ratio K and nulling resistance $R_C$ (514) and a gate source voltage $v_{GS.515}$ of the NMOS transistor 515, $P_2$ (in equation 4.15) and $Z_C$ (in equation 4.12) can be kept within a decade over no load to full load current range and thus pole-zero cancellation can be obtained over varying load current.

On the other hand, the third pole ($P_3$, in equation 4.18) continuously increases with the load current, as $$g_{mC}\left(\propto \sqrt{\frac{I_L}{K}}\right)$$

increase with the load current and it can be kept much higher than UGF over the full load current range. In contrast, third pole frequency (equation 3.8) is fixed and independent of load current for prior art 3. Therefore at higher load current third pole comes closer to the UGF and deteriorates phase margin for prior art 3, which can be avoided in the present invention by increasing the third pole frequency with load current.

The simulated values for the pole-zero locations according to an embodiment of the present invention at $I_L$ (522)=70 mA, $C_L$ (519)=100 nF, $C_C$ (513)=128 pF, $R_C$ (514)=43 KΩ, ESR (520)=100 mΩ, $V_{IN}$ (527)=1.8V and 25° C. are as follows

| | MODULUS | REAL PART | IMAGINARY PART |
|---|---|---|---|
| POLES | | | |
| 1 | 4.381568e+02 | −4.381568e+02 | −0.000000e+00 |
| 2 | 1.047755e+05 | −1.047755e+05 | −0.000000e+00 |
| 3 | 8.096984e+05 | −8.096984e+05 | −0.000000e+00 |
| ZEROS | | | |
| 1 | 8.663804e+04 | −8.663804e+04 | −0.000000e+00 |

The pole-zero locations for prior art 3 can be evaluated at the above corner for LDO 300 with a resistance $R_C$=43 KΩ in series with $C_C$ (306), which is to improve phase margin at low load current range without drawing a constant sink current through the driver transistor. The simulated pole-zero locations for prior art 3 are given as follows

| | MODULUS | REAL PART | IMAGINARY PART |
|---|---|---|---|
| POLES | | | |
| 1 | 1.694203e+02 | −1.694203e+02 | −0.000000e+00 |
| 2 | 2.553500e+05 | −1.291075e+05 | −2.203063e+05 |
| 3 | 2.553500e+05 | −1.291075e+05 | 2.203063e+05 |
| ZEROS | | | |
| 1 | 2.662746e+04 | −2.662746e+04 | −0.000000e+00 |

It is noteworthy to compare the above pole-zero locations that the complex poles of prior art 3 are converted into two real poles for the present invention. The second pole $P_2$ (equation 4.15) at 104 KHz is cancelled by the zero $Z_C$ (equation 4.12) at 86 KHz according to the pole-zero locations for the present invention. The third pole $P_3$ (equation 4.16) at 809 KHz is located outside the unity gain frequency (575 KHz) providing a phase margin greater than 57° as shown in the Bode plot of FIG. 9 for present invention.

Figure 9:
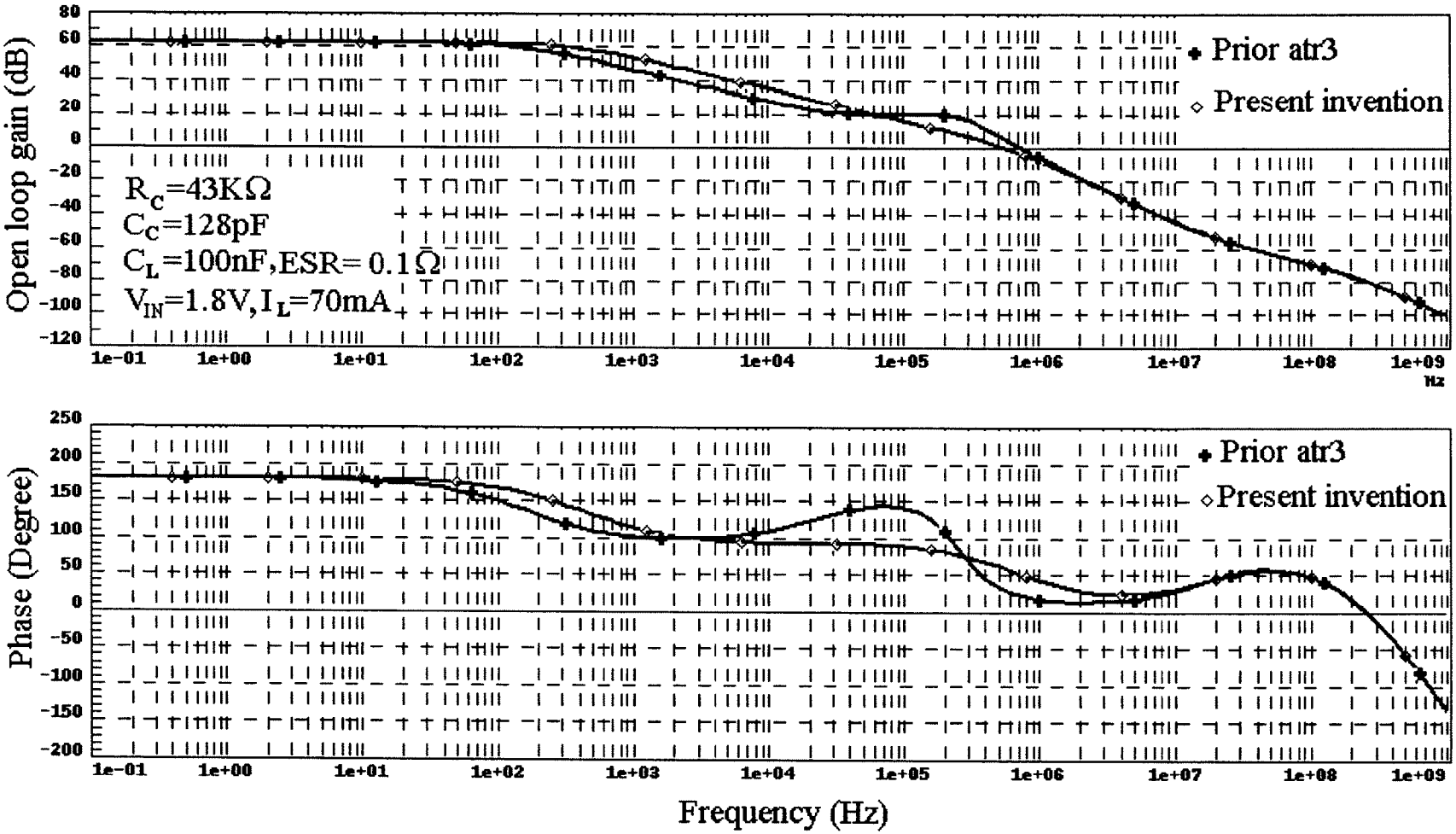
FIG. 9 illustrate the simulated Bode plots according to an embodiment of the present invention and according to two embodiments of prior art 3.

On the other hand, in case of prior art 3, the −20 dB/decade gain fall by the first pole $P_1$ (equation 3.3, $P_1$=169 Hz) is stopped by the zero $Z_C$ (equation 3.4) at 26 KHz and the residual gain falls below unity with the help of the complex pole pair (equation 3.10) at a frequency modulus 255 KHz. The complex pole pair introduces rapid gain and phase change as shown in FIG. 9 and provides a phase margin nearly equals to 21° at unity gain frequency as shown in the Bode plot of FIG. 9.

The difference in the location for the first pole ($P_1$) and the zero frequency ($Z_C$), between the present invention and prior art 3 at the same corner, is due to the fact that a new circuit is incorporated to change the voltage $v_C$ (equation 4.6) across the capacitor $C_C$ (513) with the load current $I_L$ that produces a different potential across $C_C$ (513) modifying the value in the capacitance differently in the present invention providing a good tracking of $P_2$ (equation 4.15) with $Z_C$ (equation 4.12) over no load to full load current range.

Figure 10:
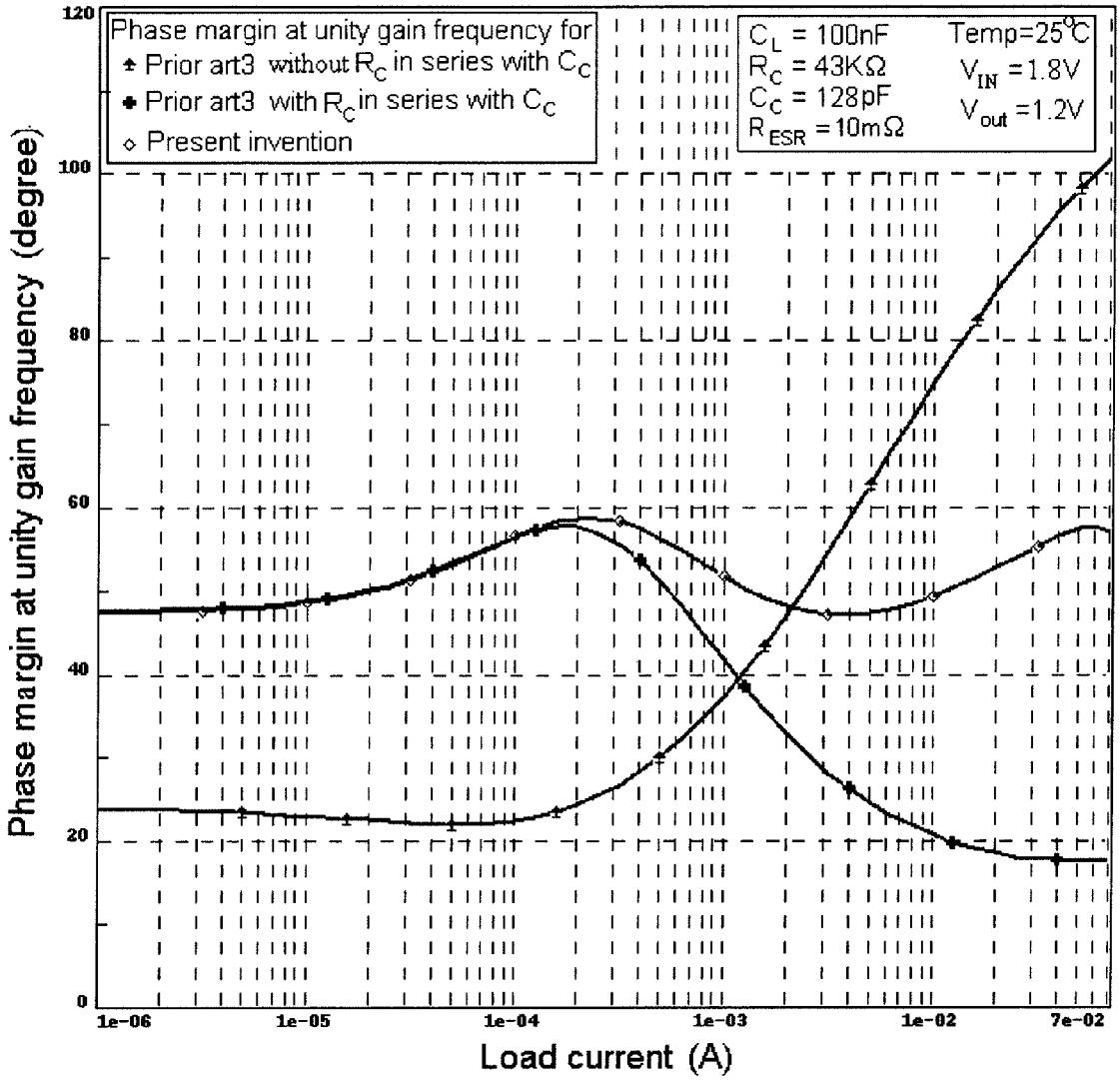
FIG. 10 illustrates the simulated variation in the value of phase margin at unity gain frequency with load current according to an embodiment of the present invention and according to two embodiments of prior art 3.

FIG. 10 shows that a phase margin at unity gain frequency varies between a minimum value of 47° to a maximum value of 59° over 0 mA to 70 mA load current range for an embodiment of the present invention. FIG. 10 also includes the phase margin at unity gain for prior art 3 (LDO 300). Two cases for LDO 300 are simulated, one with a resistor ($R_C$) in series with the compensation capacitor 306 ($C_C$) and other without $R_C$. When $R_C$ is included for prior art 3 phase margin is improved at lower load current range, but at higher current it deteriorates as shown in FIG. 10. On the other hand when $R_C$ is removed, phase margin at higher load current improves but at lower load current range phase margin is degraded as shown in FIG. 10.

In addition to the above pole-zeroes there is a another zero for small external decoupling capacitor at $$Z_{ESR} = \frac{-1}{R_{ESR}C_L} \tag{4.19}$$

Small external decoupling capacitor of the order of few tens to hundreds of nano-Farads has very small ESR, which keep the $Z_{ESR}$ frequency (equation 4.19) much greater than the UGF and it has negligible effect on the frequency response of the LDO.

With the decrease (or increase) of load capacitance ($C_L$) value the second pole frequency (equation 4.15) at no load also increases (or decrease) increasing (or decreasing) the no load UGF. Therefore value of $R_C$ (514) can be reduced (or increased) so that at no load current $Z_C$ (equation 4.12) is placed after the UGF. Accordingly the reflection factor K can be chosen for proper large signal operation of the LDO 400. In this way the present stability compensation scheme can applied to an LDO with a range of load capacitor $C_L$ (519) values suitable for safe dynamic load switching response.

Finally, in the present architecture the supply noise reaches as a common mode signal at the gate (node 523) and source (node 527) inputs of the PMOS driver transistor 512 and cancels each other at the output (node 524) providing a good PSR (Power supply rejection) value for an LDO.

While there have been described above the principles of the present invention in conjunction with specific logic designs and methods of operation, it is to be clearly understood that the foregoing description is made only by way of example and not as a limitation to the scope of the invention. Particularly, it is recognized that the teachings of the foregoing disclosure will suggest other modifications to those persons skilled in the relevant art. Such modifications may involve other features which are already known per se and which may be used instead of or in addition to features already described herein. Although claims have been formulated in this application to particular combinations of features, it should be understood that the scope of the disclosure herein also includes any novel feature or any novel combination of features disclosed either explicitly or implicitly or any generalization or modification thereof which would be apparent to persons skilled in the relevant art, whether or not such relates to the same invention as presently claimed in any claim and whether or not it mitigates any or all of the same technical problems as confronted by the present invention. The applicant hereby reserves the right to formulate new claims to such features and/or combinations of such features during the prosecution of the present application or of any further application derived therefrom.

I claim:

1. A stability compensation circuit for a low dropout regulator, the low dropout regulator including a driver transistor, the circuit comprising:

a first compensation transistor having a gate coupled to a gate of the driver transistor, a source coupled to an unregulated input voltage, and a drain;

a compensation capacitor coupled between the gate and the drain of the compensation transistor;

a second compensation transistor having a gate coupled to a drain of the driver transistor, a drain coupled to the unregulated input voltage, and a source;

a resistor coupled between the drain of the first compensation transistor and the source of the second compensation transistor; and a source of bias current coupled to the source of the second compensation transistor, wherein the compensation capacitor remains in an accumulation region at no load current to provide a maximum capacitance, and the capacitance of said compensation capacitor decreases with a load current during a higher load current region.

2. The stability compensation circuit of claim 1 wherein the ratio of the size of the driver transistor to the size of the first compensation transistor is K to 1.

3. The stability compensation circuit of claim 1 wherein the driver transistor comprises a P-channel driver transistor.

4. The stability compensation circuit of claim 1 wherein the first compensation transistor comprises a P-channel compensation transistor.

5. The stability compensation circuit of claim 1 wherein the second compensation transistor comprises an N-channel compensation transistor.

6. The stability compensation circuit of claim 1 wherein the source of bias current comprises an N-channel transistor.

7. The stability compensation circuit of claim 1 wherein the low dropout regulator further comprises an error amplifier responsive to a difference between a predetermined reference voltage and a function of a regulated output voltage to produce an error signal.

8. The stability compensation circuit of claim 1 further comprising a load capacitor coupled to an output terminal of the low dropout regulator.

9. The stability compensation circuit of claim 8 wherein a typical value of the load capacitor is about 100 nF.

10. The stability compensation circuit of claim 1 wherein a typical value of the resistor is about 43 K ohms.

11. The stability compensation circuit of claim 1 wherein a typical value of the compensation capacitor is about 128 pF.

12. The stability compensation circuit of claim 1 wherein the second compensation transistor comprises a source follower transistor.

13. The stability compensation circuit of claim 1 wherein the compensation capacitor comprises a voltage dependent compensation capacitor.

14. The stability compensation circuit of claim 1 wherein the first compensation transistor comprises a parasitic pole reshaping P-channel transistor operating in a saturation region.

15. The stability compensation circuit of claim 8 wherein the load capacitor is in the range of a few nano-Farads to a few hundred nano-Farads.

16. The stability compensation circuit of claim 1 comprising a first pole for the regulator realized at an internal node.

17. The stability compensation circuit of claim 16 further comprising a second pole at an output node of the regulator that is tracked with a variable compensation capacitor generated zero over a range of load current.

18. The stability compensation circuit of claim 17 further comprising a third pole that is pushed out above a unity gain frequency of an open loop transfer function.

19. A stability compensation circuit for a low dropout regulator, the low dropout regulator including a driver transistor, the circuit comprising:

a first compensation transistor having a gate coupled to a gate of the driver transistor, a source coupled to an unregulated input voltage, and a drain;

a compensation capacitor coupled between the gate and the drain of the compensation transistor;

a second compensation transistor having a gate coupled to a drain of the driver transistor, a drain coupled to the unregulated input voltage, and a source;

a resistor coupled between the drain of the first compensation transistor and the source of the second compensation transistor;

a source of bias current coupled to the source of the second compensation transistor;

a first pole for the regulator realized at an internal node; and a second pole at an output node of the regulator that is tracked with a variable compensation capacitor generated zero over a range of load current.

20. The stability compensation circuit of claim 19 further comprising a third pole that is pushed out above a unity gain frequency of an open loop transfer function.

* * * * *